United States Patent [19]

Kim et al.

[11] Patent Number: 4,577,119

[45] Date of Patent: Mar. 18, 1986

[54] TRIMLESS BANDGAP REFERENCE VOLTAGE GENERATOR

[75] Inventors: Suk K. Kim, Bridgewater, N.J.; Thayamkulangara R. Viswanathan, Waterloo, Canada

[73] Assignee: AT&T Bell Laboratories, Murray Hill, N.J.

[21] Appl. No.: 552,783

[22] Filed: Nov. 17, 1983

[51] Int. Cl.[4] ..... G05F 5/00

[52] U.S. Cl. ..... 307/297; 307/296 R; 307/493; 307/494; 323/316

[58] Field of Search ..... 307/296 R, 297, 491, 307/493, 494, 497; 323/311-316

[56] References Cited

U.S. PATENT DOCUMENTS

| | | | |
|---|---|---|---|
| 3,825,778 | 7/1974 | Ahmed | 307/297 X |
| 4,176,308 | 11/1979 | Dobkin et al. | 307/297 X |
| 4,243,898 | 1/1981 | Seelbach | 307/296 R X |
| 4,250,445 | 2/1981 | Brokaw | 323/313 |
| 4,263,519 | 4/1981 | Schade, Jr. | 307/297 |
| 4,302,718 | 11/1981 | Schade, Jr. | 307/296 R X |
| 4,380,706 | 4/1983 | Wrathall | 307/297 |

FOREIGN PATENT DOCUMENTS

| | | | |
|---|---|---|---|
| 22552 | 2/1979 | Japan | 323/311 |

*Primary Examiner*—Stanley D. Miller
*Assistant Examiner*—D. R. Hudspeth
*Attorney, Agent, or Firm*—David I. Caplan

[57] ABSTRACT

A voltage generator circuit consists essentially of two separate groups of serially connected semiconductor junctions with one group having one more junction than the other, two groups of constant current sources, and a differential operational amplifier. The circuit generates a reference voltage which in one embodiment is close to the bandgap voltage of silicon and is essentially constant over an operating temperature range of 25–85 degrees C. and does not require the trimming (adjusting) of resistor values. This circuit is particularly useful in CMOS CODECs. The circuit is designed such that the input offset voltage of an operational amplifier is not multiplied by the gain of the amplifier.

12 Claims, 4 Drawing Figures

V1 or V10
Q52
36 or 360
A1 or A10
26 or 260
24 or 240
150
R3 or R30
36A or 36A0
R4 or R40
V3 or V30

V1
12
A
Q18
Q19
100
102
104
Q20
Q21
106
108
Q22
16
V3
114
110
Q23
Q24
CS1
Q25
18
CS2
Q26
20
CS3
Q27
22
CS4
Q28
24
CS44
Q28A
26
CS33
Q27A
28
CS22
Q26A
30
CS11
Q25A
32
14
V2

TRIMLESS BANDGAP REFERENCE VOLTAGE GENERATOR

FIELD OF THE INVENTION

This invention relates to voltage generator circuitry and, in particular, to precise temperature-insensitive voltage generator circuits used to generate bandgap reference and other reference voltages.

BACKGROUND OF THE INVENTION

Some coder-decoder (CODEC) circuits require a voltage which is relatively close to the bandgap voltage of silicon and which remains essentialy constant over operating temperature ranges. One commonly used configuration for creating such a voltage consists of a first bipolar transistor with a current source connected to the emitter and in addition, second and third transistors with separate current sources coupled to each of the emitters. The magnitude of the current flowing through each of the second and third transistors, as well as the area of the emitters of each of these transistors, is carefully selected such that a differential output voltage occurs between the two respective emitters. One emitter is coupled to the plus input terminal of an amplifier, and the other emitter is coupled to a negative input terminal of the amplifier. The amplifier generates an output voltage which is characterized by an increase in magnitude level with increasing temperature. The output voltage at the emitter of the first transistor decreases in magnitude with increasing temperature. The gain of the amplifier is adjusted to cause the differential output voltage of the second and third transistors to be amplified such that when added to the output emitter voltage of the first transistor, the resulting output voltage is essentially constant over a useful operating temperature range. The gain of the amplifier is typically set using a pair of resistors whose ohmic value must be adjusted (trimmed) to achieve the required gain. This adjustment is undesirable in that it requires time and expense. The relative areas of the emitters of the second and third transistors and the ratio of the current therethrough can be adjusted to within limits to set the magnitude of the output emitter voltages, but it is typically not practical to vary the emitter areas and currents enough so that the output differential voltage generated is great enough to completely compensate for the output voltage variation of the first transistor. Thus, an amplifier having a preselected gain, which is achieved by trimming resistors, is used. Another problem with this type of circuitry is that the input offset voltage of the amplifier is also multiplied by the gain of the amplifier, and this must be corrected using other circuitry. Still another problem with this type of circuitry is that the output voltage of the first transistor has a somewhat curved slope and is difficult to completely compensate for. Accordingly, the output voltage of the circuitry, though relatively constant, is not as precise as may be needed in some applications.

It is desirable to have a voltage generator circuitry which does not require the trimming of resistors and in which the resultant output voltage is more constant with temperature variation than is available with much of today's existing circuitry.

SUMMARY OF THE INVENTION

The present invention is directed to voltage generator circuitry comprising an amplifier having an output terminal, and first and second input terminals, first and second groups (pluralities) of semiconductor junctions, and first, second, and third groups (pluralities) of current sources. One of the groups of junctions contains one more junction than the other. The anode of the first junction of the first plurality of junctions is coupled to a first reference voltage. The cathode of each junction of the first group is coupled to the anode of the next junction, except for the cathode of the last junction of the first group which is coupled to the first input of the amplifier. The anode of the first junction of the second group is coupled to the output terminal of the amplifier. The cathode of each junction of the second group is coupled to the anode of the succeeding junction of the second group, except for the cathode of the last junction which is coupled to the second input terminal of the amplifier. The first junction of the group of junctions which has one additional junction being coupled to first current source means, and the rest of the junctions of the group containing the extra junction being coupled to second current source means. The junctions of the other group being coupled to a third current source means.

The circuitry acts to generate at an output terminal, which is typically coupled to the output terminal of the amplifier, a voltage level which is close to the value of the bandgap voltage of silicon. In one preferred embodiment, the output voltage has a positive polarity, the second group of junctions comprise n-p-n transistors which have one more transistor than the first group of junctions which also comprise n-p-n transistors. In another embodiment, the output voltage has a negative polarity, and the first group of junctions are n-p-n transistors which have one more transistor than the second group of junctions which are also n-p-n transistors. The open loop gain of the amplifier is typically selected to be over 1,000, but the negative feedback from the output terminal of the amplifier to the second input terminal of the amplifier via the second junctions results in a closed loop gain of essentially one. Thus the magnitude of the offset potential of the amplifier which appears at the output terminal of the amplifier is essentially of the same magnitude as the input offset voltage of the amplifier.

One substantial advantage of the circuitry is that there are no resistors which must be adjusted in value to set the gain of the amplifier as is true of prior art circuitry. In addition, the circuitry generates a fairly precise output voltage level which varies little over a preselected temperature range.

These and other advantages which are features of the invention will be better understood from a consideration of the following detailed description taken in conjunction with the accompanying drawings.

DETAILED DESCRIPTION

Figure 1:
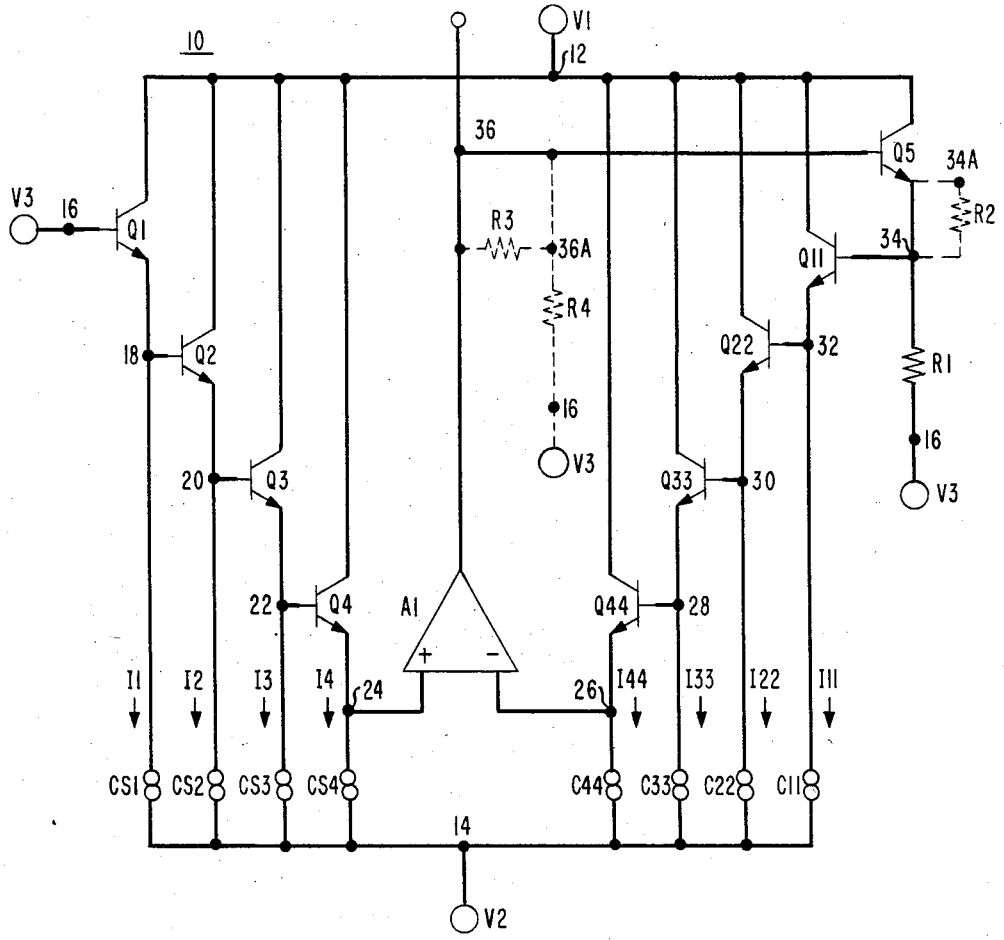
FIG. 1 illustrates one embodiment of circuitry in accordance with the present invention.

Referring now to FIG. 1, there is illustrated voltage generator circuitry 10 which has an input terminal 16 illustrated coupled to a reference voltage potential V3 and an output terminal 36 at which a relatively precise voltage level is generated which is close to the bandgap voltage of silicon. With appropriate polarities selected for power supplies used with 10, the polarity of the generated output voltage is positive.

Circuitry 10 comprises switching devices Q1, Q2, Q3, Q4, which form a first plurality (group) of transistors (switching devices), and switching devices Q5, Q11, Q22, Q33, and Q44 which form a second plurality (group) of transistors (switching devices). Each of these switching devices is in a preferred embodiment, an n-p-n junction type bipolar transistor. In addition, circuitry 10 comprises a first plurality (group) of essentially constant current sources CS1, CS2, CS3, and CS4, a second plurality (group) of constant current sources CS11, CS22, CS33, and CS44, an amplifier A1 having first and second input terminals 24 and 26, and an output terminal coupled to circuitry output terminal 36, resistor circuit means R1, which in a preferred embodiment is a resistor, optional resistor circuit means R2, which is typically a resistor, and optional gain circuit means which is illustrated by resistor circuit means R3 and R4, which are both typically resistors. R2 serves to increase design flexibility. A1 is in one typical embodiment a differential operational amplifier having a gain of typically 1,000 and having terminals 24 and 26 as the positive and negative input terminals, respectively.

Circuitry 10 acts to effectively add the difference between the voltage drop across the emitterbase junctions of Q1, Q2, Q3, and Q4 and those across the emitter-base junctions of Q5, Q11, Q22, Q33, and Q44 to generate the desired reference voltage at output terminal 36.

Theoretically only a single transistor from the group of transistors Q1, Q2, Q3, and Q4 and a single transistor from the group of transistors Q11, Q22, Q33, and Q44 are needed, but this would require great differences in the current levels in the two transistors used and great differences in their emitter areas. This as a practical matter is difficult to achieve, and prior art voltage generators which used only two transistors required an amplifier with a closed loop gain greater than one so as to obtain the needed output voltage such that when added to the emitter-base voltage of Q5, the desired semiconductor bandgap voltage was obtained. This also caused the inherent offset voltage of the amplifier used to be multiplied by the closed loop gain of the amplifier and to appear at the output terminal.

The collectors of Q1, Q2, Q3, Q4, Q5, Q11, Q22, Q33, and Q44 are all coupled to a terminal 12 and to a power supply V1 which, in one illustrative embodiment, is positive. Second terminals of each of CS1, CS2, CS3, CS4, CS11, CS22, CS33, and CS44 are coupled to a terminal 14 and to a power supply V2 which, in one illustrative embodiment, is negative. The emitter of Q1 is coupled to the base of Q2, to a first terminal of CS1, and to a terminal 18. The emitter of Q2 is coupled to the base of Q3, a first terminal of CS2, and to a terminal 20. The emitter of Q3 is coupled to the base of Q4, to a first terminal of CS3, and to a terminal 22. The emitter of Q4 is coupled to input terminal 24 of A1, a first terminal of CS4, and to a terminal 24. The base of Q5 is coupled to output terminal 36. The emitter of Q5 is coupled to the base of Q11, to a first terminal of R1, and to a terminal 34. A second terminal of R1 is coupled to a terminal 16 and to voltage source V3. The emitter of Q11 is coupled to the base of Q22, to a first terminal of CS11, and to a terminal 32. The emitter of Q22 is coupled to the base of Q33, to a first terminal of CS22, and to a terminal 30. The emitter of Q33 is coupled to the base of Q44, to a first terminal of CS33, and to a terminal 28. The emitter of Q44 is coupled to input terminal 26 of A1 and to a first terminal of CS44. R2, which is optional, is coupled by a first terminal to the emitter of Q5 and to a terminal 34A, and is coupled by a second terminal to terminal 34. As such R2 is connected between the emitter of Q5 (now terminal 34A) and terminal 34. R3, when used, is coupled by a first terminal to terminal 36 and by a second terminal of R3 coupled to a first terminal of R4 and to a terminal 36A which is also coupled to the base of Q5. A second terminal of R4 is coupled to terminal 16 and to V3. With R3 and R4 being used, the direct connection from terminal 36 to the base of Q5 is broken. The output voltage appearing at terminal 36 is now equal to what it was previously, without the use of R3 and R4, times (1+R3/R4). The voltage appearing on terminal 36A is what appeared on terminal 36 when R3 and R4 were not used.

All of Q1, Q2, Q3, Q4, Q5, Q11, Q22, Q33, and Q44 are designed to have relatively large current gains (betas) such that the base currents are all relatively small, and therefore the emitter and collector current through any transistor is almost equal. The currents generated by the respective current sources are indicated by the letter I, with the number of the transistor through which it flows following the "I". For example, the current flowing through Q2 is I2.

Typically, I1=I2=I3=I4, I11=I22=I33=I44, I11->I1, the emitter areas of Q1, Q2, Q3 and Q4 are equal, the emitter areas of Q11, Q22, Q33 and Q44 are equal, and the ratio of the emitter area of Q1 to the emitter area of Q11 is greater than 1.

The voltage appearing at positive input terminal 24 of A1 equals 0 volts minus the emitter-base voltage across each of Q1, Q2, Q3, and Q4. The emitter-base voltage drop across each of Q1, Q2, Q3, and Q4 is essentially the same since all have the same emitter area and the same current flowing therethrough. Thus, the potential appearing at terminal 24 is 0−4VBEQ1=−4VBEQ1. The voltage appearing at negative input terminal 26 is V36 (the output voltage at terminal 36) minus the emitter-base voltage across Q5, Q11, Q22, Q33, and Q44. The emitter-base voltage drop across each of Q11, Q22, Q33, and Q44 is essentially equal since they have the same emitter area and current flowing therethrough. Thus, the voltage appearing at negative input terminal 26=V36−VBE5−4VBEQ11. A1 amplifies the difference in voltage levels appearing at input terminals 24 and 26 by the gain thereof and produces the bandgap reference voltage at output terminal 36. The use of the negative feedback path from terminal 36 through Q5, Q11, Q22, Q33, and Q44 to input terminal 26 results in the closed loop gain of A1 being 1. This ensures that any offset potential associated with A1 is not amplified by the gain of A1. The output voltage at terminal 36 stays relatively constant even if I1, I2, I3, I4, I11, I22, I33 and I44 vary so long as the ratios of I1/I11, I2/I22, I3/I33 and I4/I44 remain relatively constant.

It is to be noted that the use of a resistor for R1 tends to result in an output voltage at terminal 36 which has less variation with temperature change than when R1 is a constant current. As the temperature of Q5 increases, the voltage across the emitter-base junction thereof, the VBE, decreases in a nonlinear manner. The voltage at terminal 34 increases with increasing temperature, independent of where R1 is a resistor and constant current source. With R1 being a resistor, the current flow therethrough, and essentially the current flow through the collector-emitter and emitter-base junction of Q5, increases with increasing temperature. This increase in the current flow through the emitter-base junction of Q5 causes the VBE variation to be more linear with temperature variation. The essentially linear variation of the VBE of Q5 is essentially completely compensated for by the essentially opposite linear variation at terminal 34 such that the output voltage appearing at terminal 36 is essentially flat over a useful operating temperature range.

Figures 2, 4:
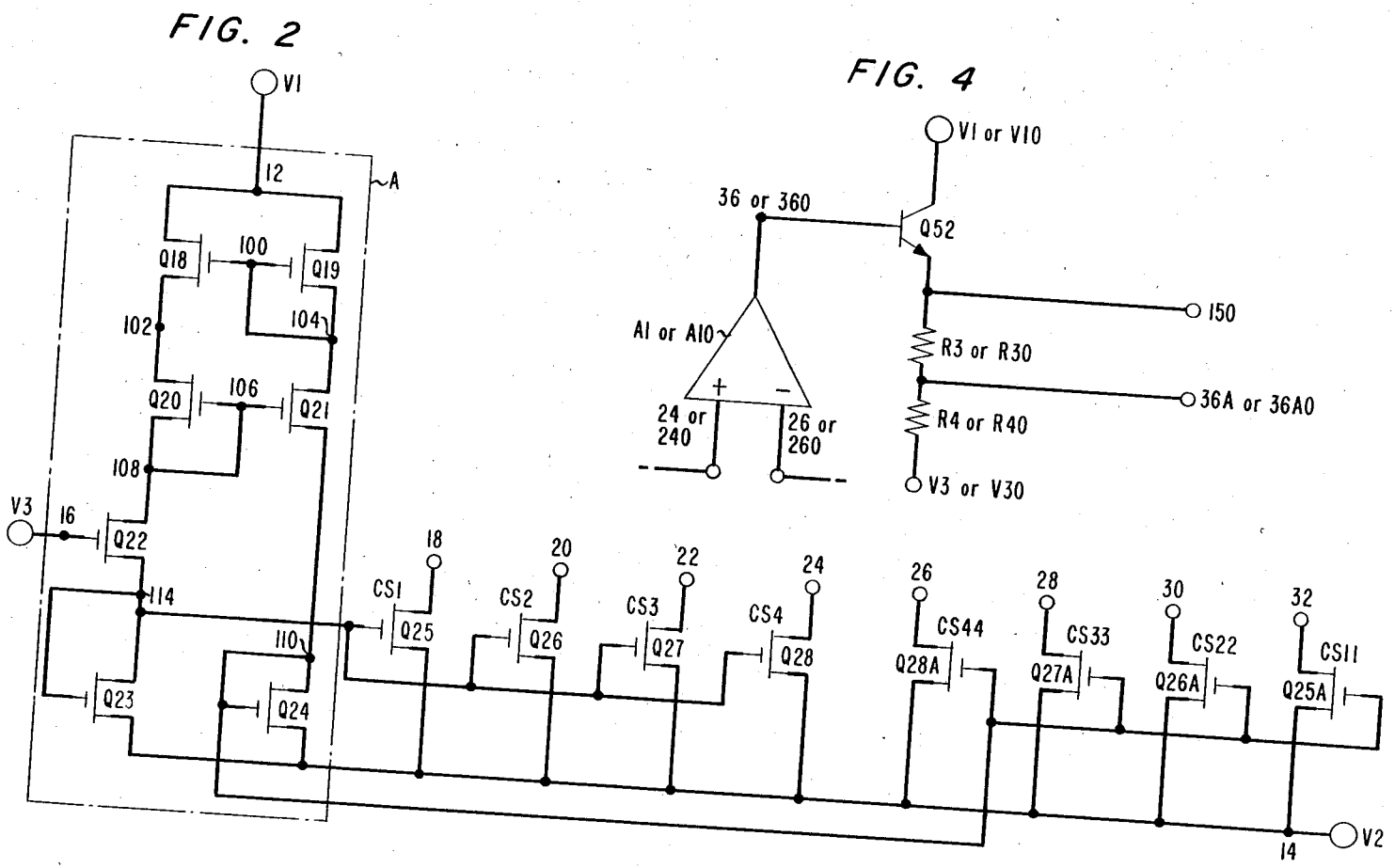
FIG. 2 illustrates one embodiment of the current sources of FIG. 1.
FIG. 4 illustrates circuitry which can be used with the circuitry of FIG. 1 or FIG. 2.

Referring now to FIG. 2, there is illustrated a preferred embodiment of the constant current sources CS1, CS2, CS3, CS4, CS11, CS22, CS33, and CS44 of FIG. 1 which each comprises a separate field effect transistor Q25, Q26, Q27, Q28, Q25A, Q26A, Q27A, and Q28A, respectively. Biasing circuitry, illustrated in dashed line rectangle A, comprises field effect transistors Q18, Q19, Q20, Q21, Q22, Q23, and Q24. It is coupled by a first output terminal 114 to the gates of Q25, Q26, Q27, and Q28 and is coupled by a second output terminal 110 to the gates of Q25A, Q26A, Q27A, and Q28A. Biasing circuitry A generates at terminals 110 and 114 the potential levels needed to generate the desired current levels in the current sources coupled to output terminals 110 and 114.

The sources of Q18 and Q19 are coupled to terminal 12 and power supply V1. The gates of Q18 and Q19 are coupled to the drain of Q19, the source of Q21, and to a terminal 104. The drain of Q18 is coupled to the source of Q20 and to a terminal 102. The gates of Q20 and Q21 are coupled to the drain of Q22 and to a terminal 108. The source of Q22 is coupled to the gate and drain of Q23 and to first output terminal 114. The gate of Q22 is coupled to terminal 16 and to voltage source V3. The drain of Q21 is coupled to the drain and gate of Q24 and to second output terminal 110. The sources of Q23, Q24, Q25, Q26, Q27, Q28, Q25A, Q26A, Q27A, and Q28A are coupled to terminal 14 and the power supply V2.

In an illustrative embodiment, the circuitry of FIG. 1 and 2 is formed on a single integrated circuit chip which essentially uses complementary metal-oxide-silicon technology (CMOS) with Q18, Q19, Q20, and Q21 being p-channel devices, Q22, Q23, Q24, Q25, Q26, Q27, Q28, Q25A, Q26A, Q27A, and Q28A being n-channel devices, and transistors Q1, Q2, Q3, Q4, Q5, Q11, Q22, Q33, and Q44 being n-p-n transistors having common collectors and effectively being parasitic transistors of the CMOS technology.

Figure 3:
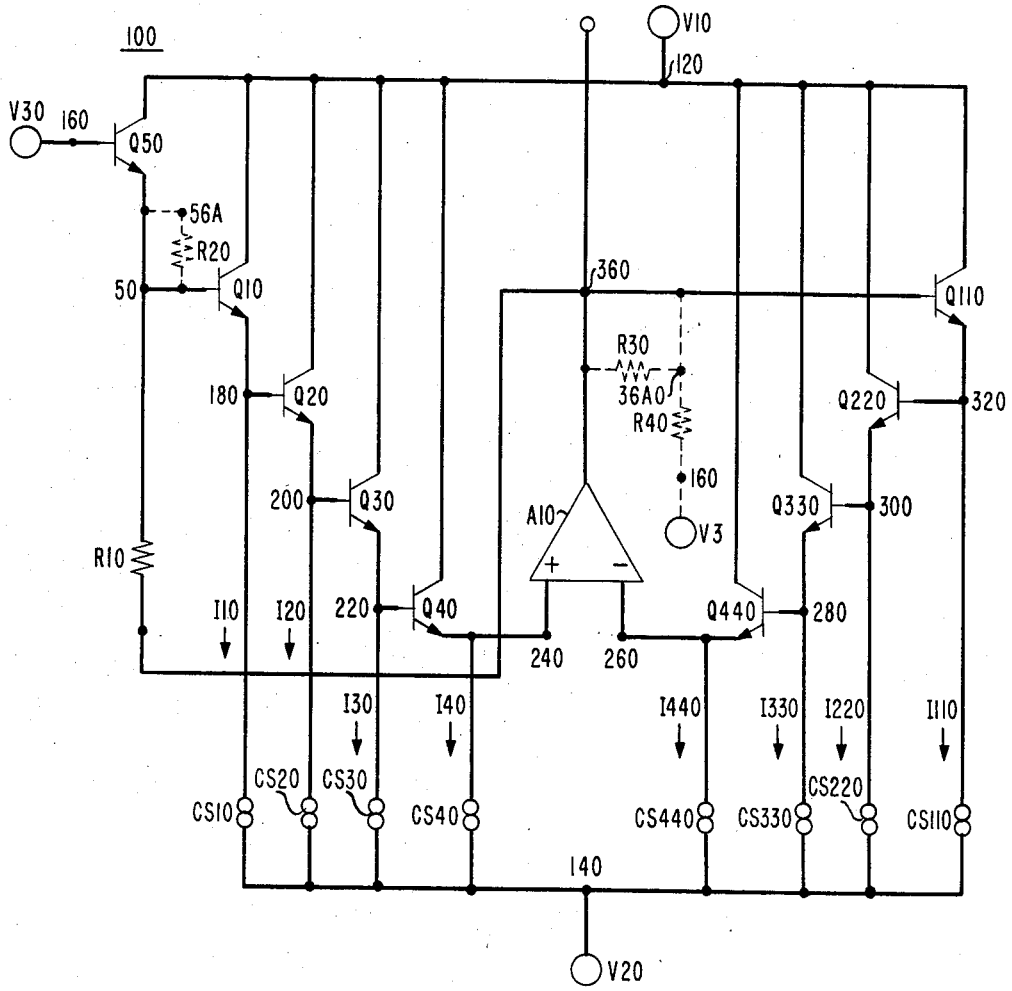
FIG. 3 illustrates another embodiment of circuitry in accordance with the present invention.

Referring now to FIG. 3, there is illustrated voltage generator circuitry 100 which, when powered by appropriately selected power supplies, produces at an output terminal 360 a negative potential having a magnitude close to the bandgap voltage of silicon. Circuitry 100 comprises a first plurality (group) of switching devices (transistors) Q10, Q20, Q30, Q40, and Q50, a second plurality (group) of switching devices (transistors) Q110, Q220, Q330, and Q440, an amplifier A10 having a first positive input terminal 240, a second negative input terminal 260, and an output terminal 360, a first plurality (group) of essentially constant current sources CS10, CS20, CS30, and CS40, a second plurality (group) of essentially constant current sources CS110, CS220, CS330, and CS440, a first resistor circuit means R10, an optional second resistor circuit means R20, and optional voltage gain means comprising resistor circuit means R30 and R40.

Circuitry 100 is very similar to circuitry of FIG. 1, and all components and circuit terminals which are similar are denoted by the same reference number with a "O" added thereto. The major difference between the two circuits is that transistor Q5 of FIG. 1, which is denoted in FIG. 3 as Q50, has the base coupled to an input terminal 160 and has the emitter coupled to the emitter of Q10, a first terminal of resistor circuit means R10, and to a terminal 50. In addition, R10 is coupled by a second terminal thereof to output terminal 360 instead of to voltage source V30. In addition, the base of Q110 is coupled to an output terminal 360. All other components are essentially coupled together as are the corresponding components of FIG. 1. Typically, $I10=I20=I30=I40$, $I110=I220=I330=I440$, $I10>I110$, the emitter areas of Q10, Q20, Q30, and Q40 are equal, the areas of Q110, Q220, Q330, and Q440 are equal, and the ratio of the emitter area of Q10 to the emitter of Q110 is less than 1.

Circuitry 100 acts essentially as circuitry 10 of FIG. 1 except that circuitry 100 results in the output voltage level appearing at terminal 360 having a negative polarity and having a magnitude close to the bandgap voltage of silicon.

Now referring to FIG. 4, there is illustrated a transistor Q52 which can be used with circuitry 10 of FIG. 1 or with circuitry 100 of FIG. 3 to improve the output drive capability of both circuitries when R3 and R4 or R30 and R40 are used. The base, emitter, and collector of Q52 are coupled to the output of A1 or A10, to an output terminal 150 and to R3 or R30, and to V1 or V10, respectively. The first terminal of each of R3 and R30 is coupled to terminal 150. The second terminal of each of R3 and R30 is coupled to the first terminal of R4 and R40, respectively, and to terminals 36A and 360A, respectively. The second terminal of each of R4 and R40 are coupled to V3 and V30, respectively. Q52 acts essentially as an emitter follower which is characterized by relatively low output impedance and therefore has good drive capabilities. The output voltage and terminal 150 equals essentially $(1+R3/R4)$ X the voltage at terminal 36A.

The circuitry 10 of FIG. 1, modified to include Q52, R3 and R4, has been fabricated in silicon with A1 being formed from CMOS components. $V1=+5$ volts, $V2=-5.0$ volts, $V3=0$ volts, $I1=I2=I3=I4=0.7\ \mu A$, $I1=I22=I33=I44=20\ \mu A$, the emitter areas of Q1, Q2, Q3 and Q4 are all equal, the emitter areas of Q11, Q22, Q33, and Q44 are all equal, the ratio of the emitter area of Q1 to Q11 equals 7, and $R3=36.86$ kohms, and $R4=30.0$ kohms. The measured voltage at terminal 36A (the base of Q5) is 1.2597, 1.2598, and 1.2590 volts for temperatures of 25 degrees C., 50 degrees C., and 85 degrees C., respectively. The measured voltage at terminal 150 is 2.7958, 2.7960, and 2.7965 volts, for temperatures of 25 degrees C., 50 degrees# C. and 85 degrees C., respectively. Over ten separate circuits 10, all having the modification illustrated in FIG. 4, were tested and it was found that at a given temperature the output voltages were all within approximately ±5 millivolts of each other. These various circuits came from different silicon wafers and thus it is expected that the output voltage will be relatively the same even with variations that may occur on different silicon wafers.

The embodiments described herein are intended to be illustrative of the general embodiments of the invention.

Various modifications are possible consistent with the spirit of the invention. For example, the number of transistors in one group can be varied from 1 to N, and the number in the other group can be varied from 2 to N+1. Still further, series junction diodes could be substituted for transistors with only one current source used for each plurality of semiconductor junctions or with one current source used for the plurality of semiconductor junctions which has the one less junction, a second current source used with all of the other junctions, except the first which has a separate third current source used therewith. Still further, a first current source could be used with all of the first plurality of junctions and a second current source could be used with all of the second plurality of junctions. Still further, the current sources could be bipolar transistors or a variety of other types of current sources. Still further, the biasing circuits for the current sources could be fabricated from bipolar transistors or could be many other types of components. Still further, R1 of FIG. 1 and R10 of FIG. 2 could each be replaced with a constant current source. This would to some extent degrade the output voltage versus temperature characteristic.

What is claimed is:

1. Voltage generator circuitry comprising:

an amplifier having an output terminal and first and second differential input terminals;

a first plurality of semiconductor junctions each having an anode and a cathode, the anode of the first junction in the first plurality of junctions being connectable to a first reference voltage, and the cathode of each junction in the first plurality of junctions being coupled to the anode of the next junction in the first plurality of junctions, except that the cathode of the last junction is coupled to the first input terminal of the amplifier;

a second plurality of semiconductor junctions each having an anode and a cathode, one of the first and second pluralities of junctions containing one more junction than the other, the anode of the first junction in the second plurality of junctions being coupled to the output terminal of the amplifier, and the cathode of each of the junctions in the second plurality of junctions being coupled to the anode of the next junction in the second plurality of junctions, except that the cathode of the last junction in the second plurality of junctions is coupled to the second input terminal of the amplifier;

a first current source means coupled to a first semiconductor junction which is in the said one of the pluralities;

a second current source means coupled to the remaining junctions in the said one of the pluralities;

a third current source means coupled to all of the junctions in the other plurality.

2. The voltage generator circuitry of claim 1 wherein:

the first plurality of semiconductor junctions comprises a first plurality of junction transistors each having at least a base and an emitter, with the anode and cathode of each junction being the base and emitter, respectively, of each transistor in the first plurality of transistors;

the second plurality of semiconductor junctions comprises a second plurality of junction transistors each having at least a base and an emitter, with the anode and cathode of each junction being the base and emitter, respectively, of each transistor in the second plurality of transistors, one of the first and second pluralities of transistors containing one more transistor than the other plurality of transistors contains;

the second current source means comprises a plurality of first individual current sources each coupled to a separate one of the transistors in the one plurality of transistors except for the first transistor in said one plurality of transistors;

the third current source means comprises a plurality of second individual current sources each coupled to a separate one of the transistors in the other plurality of transistors; and the output terminal of the amplifier is coupled to a circuitry output terminal.

3. The circuitry of claim 2 wherein the second plurality of transistors comprises one more transistor than the first plurality of transistors.

4. The circuitry of claim 3 wherein all current sources, except for the current source coupled to the first transistor of the second plurality of transistors, are essentially constant current sources, and the current source coupled to the first transistor of the second plurality of transistors is a first resistive means whose ohmic value is selected such that same acts as an essentially constant current source except for variations of current therethrough as a function of the potential of the emitter of the first transistor of the second plurality of transistors.

5. The circuitry of claim 4 further comprising:

a second resistive means having first and second terminals, the first terminal being coupled to the emitter of the first transistor of the second plurality of transistors and the second terminal being coupled to the base of the second transistor of the second plurality of transistors.

6. The circuitry of claim 2 wherein the first plurality of transistors comprises one more transistor than the second plurality of transistors.

7. The circuitry of claim 6 wherein all of the current sources, except the current source coupled to the first transistor of the first plurality of transistors, are essentially constant current sources, and the current source coupled to the first transistor of the first plurality of transistors is a resistive means whose ohmic value is selected such that same acts as an essentially constant current source except for variations of the current flowing therethrough as a function of the potential of the emitter of the first transistor of the first plurality of transistors.

8. The circuitry of claim 7 further comprising:

a second resistive means having first and second terminals, the first terminal being coupled to the emitter of the first transistor of the first plurality of transistors and the second terminal being coupled to the base of the second transistor of the first plurality of transistors.

9. The circuitry of claim 5 or 8 further comprising third and fourth resistive circuit means each having first and second terminals, the first terminal of the third resistive circuit means being coupled to the output terminal of the amplifier, and the second terminal of the third resistive circuit means being coupled to the first terminal of the fourth resistive circuit means and to the base terminal of the first transistor of the second plurality of transistors.

10. The circuitry of claim 4 or 7 wherein the essentially constant current sources each comprises a separate field effect transistor.

11. The circuitry of claim 10 wherein the amplifier is a differential operational-type amplifier with one input terminal being the positive terminal and the other being the negative input terminal and with the amplifier having high input impedance, low output impedance, and relatively high gain.

12. Circuitry comprising a differential amplifier having first and second input terminals and an output terminal

CHARACTERIZED BY:

a first plurality of semiconductor junctions each having an anode and a cathode terminal;

a second plurality of semiconductor junctions each having an anode and a cathode terminal;

the anode terminal of the first junction in the first plurality being connectable to a first reference voltage, and the cathode terminal of each junction in the first plurality being coupled to the anode terminal of the next junction in the first plurality, except that the cathode terminal of the last junction in the first plurality is coupled to the first input terminal of the amplifier;

the anode terminal of the first junction in the second plurality being coupled to the output terminal of the amplifier, and the cathode terminal of each of the junctions in the second plurality being coupled to the anode terminal of the next of the junctions in the second plurality, except that the cathode terminal of the last junction in the second plurality is coupled to the second input terminal of the amplifier;

one of the first and second pluralities junctions containing one more junction than the other;

first current source means coupled to the first junction in the said one of the pluralities of junctions;

second current source means coupled to the remaining junctions of the said one of the pluralities of junctions; and third current source means coupled to all of the junctions in the other plurality of junctions.

* * * * *